United States Patent [19]

Wagner et al.

[11] 4,370,919

[45] Feb. 1, 1983

[54] VENT CAP ASSEMBLY FOR A MONITORING WELL

[75] Inventors: Walter R. Wagner, Minneapolis; Richard M. Duda, Maplewood, both of Minn.

[73] Assignee: UOP Inc., Des Plaines, Ill.

[21] Appl. No.: 229,392

[22] Filed: Jan. 29, 1981

[51] Int. Cl.[3] ..... F23L 17/02

[52] U.S. Cl. ..... 98/122; 138/89; 138/96 R

[58] Field of Search ..... 138/89, 96 R; 220/85 P, 220/210, 366, 86 AT; 166/79; 98/122, 59

[56] References Cited

U.S. PATENT DOCUMENTS

| | | | |
|---|---|---|---|
| 1,499,629 | 7/1924 | Arnold | 220/86 AT |
| 1,653,137 | 12/1927 | Trumble | 220/210 |
| 1,656,318 | 1/1928 | Costello | 220/210 |
| 2,179,191 | 11/1939 | McWilliams | 138/89 X |
| 2,210,996 | 8/1940 | Woods | 220/366 X |
| 2,422,070 | 6/1947 | Bettencourt | 138/89 X |
| 3,302,816 | 2/1967 | Sloper et al. | 220/366 X |
| 3,964,376 | 6/1976 | Sanke | 98/59 |

*Primary Examiner*—James E. Bryant, III

*Attorney, Agent, or Firm*—James R. Hoatson, Jr.; Barry L. Clark; William H. Page, II

[57] ABSTRACT

Vent cap assembly for a monitoring well permits venting from a well riser pipe while positively preventing contamination of the well by vandals. Tabs having apertures are integrally attached to the pipe and to an axially elongated vent cap. A padlock may be placed through the apertures to prevent unauthorized removal of the cap, but whether or not the cap is locked, the tab on the riser pipe causes the inner end surface of the cap to be spaced slightly above the riser pipe to insure that venting will always be possible.

2 Claims, 2 Drawing Figures

VENT CAP ASSEMBLY FOR A MONITORING WELL

BACKGROUND OF THE INVENTION

The invention relates to riser pipes of the type found in wells used for monitoring the quality of ground water. Such wells are provided in many areas such as around landfills and other places where it is environmentally desirable to constantly check for possible contamination of the water table. Periodically, containers are lowered down a well to permit sampling of the quality of the water. In many areas, the wells are quite accessible so it would appear desirable to cap them except when samples are being taken. Capping would prevent vandals from dropping foreign material into the well which could destroy its usefulness. However, it would also be desirable that the riser pipe be vented to the atmosphere at all times.

SUMMARY

It is among the objects of the present invention to provide a venting cap assembly for a riser pipe which will insure venting while preventing the contamination of a well by vandals. These and other objects are attained by the cap assembly system of the present invention in which a first apertured tab is provided on the riser pipe and a second apertured tab is provided on the vent cap. The tabs are adapted to be aligned with each other so that a padlock can be placed through them. The tab on the pipe riser is attached to the riser at a height from the top of the riser which is less than the internal height of the vent cap. Thus, the cap will always be able to vent the pipe. If desired, a second pipe tab can be placed on a riser. A second tab would prevent cocking of the cap as would occur when the cap is supported at only one point. The riser pipe tab or tabs also make a convenient support surface for anchoring the sampling equipment as it is lowered into the well.

DESCRIPTION OF THE PREFERRED EMBODIMENT

Figure 1:
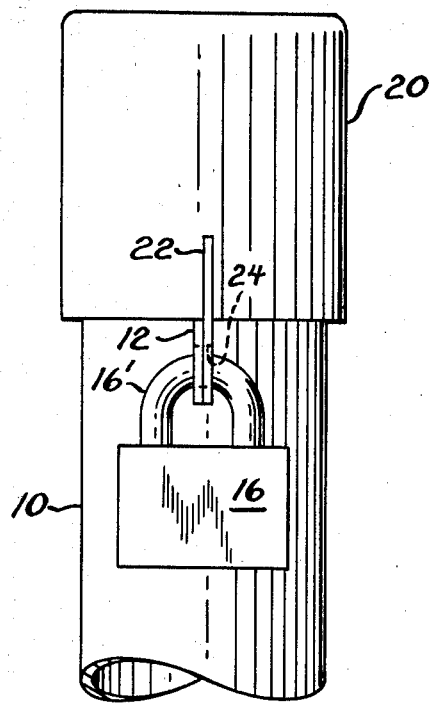
FIG. 1 is a side view of a riser pipe with a vent cap assembly locked to it.

The riser pipe 10 commonly protrudes above the surface of the ground and has an open top end portion 10' through which sampling equipment (not shown) can be lowered. Venting of the pipe must also be permitted at all times. The pipe 10 has at least one tab 12 attached to it at a spaced distance from its end 10' and the tab includes an aperture 14 through which the shackle portion 16' of a padlock 16 can pass. The cap 20 is hollow and of slightly greater diameter than the pipe 10 so as to provide sufficient clearance for venting but not enough to permit a vandal to pry the cap off or get foreign material under it. A tab 22 is welded on the cap 20 and has an aperture 24 which is aligned with aperture 14 when the cap rests on top of tab 12. The inside height of the cap 20 between its lower edge 20' and its upper inside surface is greater than the height of the riser above the tab 12. Thus, irrespective of whether a padlock 16 is in place, venting can take place.

Figure 2:
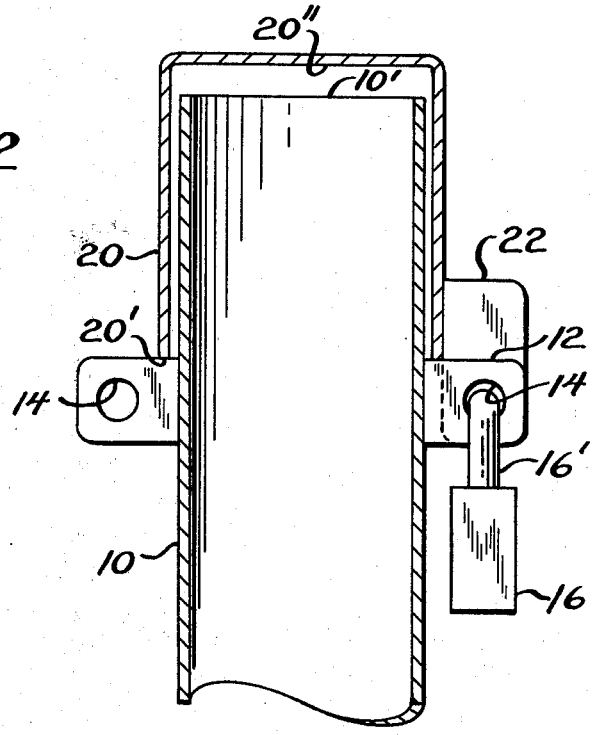
FIG. 2 is a side view taken at 90° to FIG. 1 with the pipe and cap in section

Although a pair of spaced tabs 12 are illustrated in FIG. 2, only one of them is really necessary to provide locking of the vent cap 20. The second tab is, however, useful in combination with the first tab as a mounting structure for sampling equipment (not shown) which one might wish to attach to the riser pipe when the cap is removed for the taking of samples. The second tab also prevents the cap from tilting into contact with the riser pipe.

We claim as our invention:

1. A venting cap assembly system for protecting the upper end of a monitoring well riser pipe from contamination, said system comprising a first tab member attached to the side of the riser pipe at a predetermined distance from its top, a hollow cap member having an inner diameter which is slightly greater than the outer diameter of said riser pipe upon which said cap is placed by an amount sufficient to provide a venting passageway which is open at all times, a second tab member integrally attached to said cap member, an aperture in each of said tab members which is sized so as to be capable of receiving a padlock and positioned so that the apertures can be aligned with each other when the cap member is assembled over the top of said riser pipe with the tab members immediately adjacent one another and when the cap is resting on the first tab, said cap member having cylindrical internal side wall portions which are at least sufficiently longer than said predetermined distance that the inner end surface of said cap will be vertically spaced from the upper end of said riser pipe when said cap member is resting on said first tab member.

2. A venting cap assembly system according to claim 1 wherein said system further includes a third tab member which is attached to the side of the riser pipe at a location which is circumferentially spaced from the first tab member.

* * * * *